US007339551B2

(12) United States Patent
Peterson

(10) Patent No.: US 7,339,551 B2
(45) Date of Patent: Mar. 4, 2008

(54) REFLECTIVE FRESNEL LENS FOR SUB-MILLIMETER WAVE POWER DISTRIBUTION

(75) Inventor: Kent E. Peterson, Hoffman Estates, IL (US)

(73) Assignee: Northrop Grumman Corporation, Los Angeles, CA (US)

( * ) Notice: Subject to any disclaimer, the term of this patent is extended or adjusted under 35 U.S.C. 154(b) by 61 days.

(21) Appl. No.: 11/018,195

(22) Filed: Dec. 21, 2004

(65) Prior Publication Data

US 2006/0132379 A1 Jun. 22, 2006

(51) Int. Cl.

| | |
|---|---|
| ***H01Q 15/02*** | (2006.01) |
| ***H01Q 15/24*** | (2006.01) |
| ***H01Q 19/10*** | (2006.01) |
| ***H01Q 13/00*** | (2006.01) |
| ***H01Q 15/08*** | (2006.01) |

(52) U.S. Cl. ..... 343/910; 343/755; 343/786; 343/911 R

(58) Field of Classification Search ..... 343/700 MS, 343/753, 754, 755, 786, 909, 911 R, 910
See application file for complete search history.

(56) References Cited

U.S. PATENT DOCUMENTS 5,486,950 A * 1/1996 Collinge ..... 359/565
5,675,349 A * 10/1997 Wong ..... 343/910
6,246,369 B1 * 6/2001 Brown et al. ..... 343/700 MS
6,473,049 B2 * 10/2002 Takeuchi et al. ..... 343/753

OTHER PUBLICATIONS

Dickey et al., Laser Beam Shaping, Theory and Techniques, 2000, 22 pages, Macel Dekker, Inc.

Theunissen et al., A Contour Beam Synthesis Method Using . . . , 2003, 4 pages, IEEE.

Roberts, Beam Shaping by Holographic Filters, Jan. 1988, 4 pages, British Aerospace, Filton, Bristol UK.

Meltaus et al., Millimeter-Wave Beam Shaping Using Holograms, Apr. 2003, 7 pages, IEEE, vol. 51, No. 4.

* cited by examiner

*Primary Examiner*—Shih-Chao Chen
(74) *Attorney, Agent, or Firm*—Stetina Brunda Garred & Brucker

(57) ABSTRACT

A reflective Fresnel lens for shaping an incident wave for efficiently delivering the incident wave to an array of receivers, having a wavelength within a predetermined range. The Fresnel lens comprises a ground plate and a plurality of reflective elements formed at various levels of the ground plate. The predetermined range includes millimeter wavelength range, sub-millimeter wavelength range or microwave wavelength range.

29 Claims, 2 Drawing Sheets

REFLECTIVE FRESNEL LENS FOR SUB-MILLIMETER WAVE POWER DISTRIBUTION

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

The present invention relates in general to a sub-millimeter wave power distribution device for, and more particularly, to a device using reflective element to obtain a beam shaped as desired to deliver uniform power to a surface.

Millimeter-wave systems offer broad bandwidth and high resolution for radar and imaging applications. Due to the low atmospheric attenuating feature, millimeter waves are ideal for building radars and cameras that can penetrate clouds, smoke, and haze. Systems applications have been limited by the availability of high power sources, which are becoming available. This initiates the need for distributing such high power at millimeter or sub-millimeter wavelengths to an array of detecting or sensing elements.

A variety of techniques have been developed to combine output powers of several power sources, or divide the power of one source. Existing techniques include the resonant approach and the non-resonant approach. In the resonant combining approach, the power sources coherently inject their energies into an eigenmode of a shielded or open resonator. The non-resonant approach is mainly based on spatial combining/dividing of energy. To avoid mode competition in the resonant approach and grating lobes in the non-resonant approach, the sources or receivers are arranged within a space dictated by the wavelength, that is, the distance between neighboring sources and devices is typically equal or less than half a wavelength.

To overcome the above shortcomings and to allow sufficient geometrical spacing, holographic power combining circuit is proposed. For example, Shahabadi et al. proposed a millimeter-wave beam splitter consisting of a hologram and an antenna array published in "Millimeter-Wave Holographic Power Splitting/Combining" in IEEE transactions on Microwave Theory and Techniques, Vol. 45, No. 12, December 1997. Holt et al. proposed a quasi-optical holographic power combining circuit published in "Broadband Analysis of a D-Band Holographic Power Combining Circuit", IEEE MTT-Symposium, May 2001. In the disclosure of Shahabadi et al., the beam reconstruction is realized within a one-dimensional transmissive structure instead of free space. Holt et al. uses a parallel-plate transmission structure to realize the beam reconstruction. Similar to Shahabadi et al., the signal propagation is limited to one dimension since the one-dimensional array of beam splitter is used.

BRIEF SUMMARY OF THE INVENTION

The present invention provides a reflective Fresnel lens for shaping an incident wave having a wavelength within a predetermined range. The Fresnel lens comprises a ground plate and a plurality of reflective elements formed at various levels of the ground plate. The predetermined range includes millimeter wavelength range, sub-millimeter wavelength range or microwave wavelength range.

In one embodiment, the ground plate includes a plurality of substrates stacked together, and the substrates are transparent to the incident optical wave. The Fresnel lens further comprises a reflective layer coated on a bottom surface of the ground plate. The reflective layer includes a conductor coating, and the substrate is fabricated from glass, for example. The reflective elements include a plurality of patterned thin-film conductors formed on the substrates. The patterned thin-film conductors have a width smaller than the wavelength of the incident wave. The thin-film conductors are preferably fabricated from gold, for example. The patterned thin-film conductors have a width of about 1/100th of the wavelength of the incident wave.

In another embodiment, the ground plate includes a top side patterned to form a plurality of trenches. The Fresnel lens further comprises a reflective layer coated on the top side of the ground plate. Preferably, the reflective layer is conformal to a surface profile of the top side of the ground plate. Each of the trenches includes multiple steps formed along at least one sidewall thereof. That is, each trench includes a steep sidewall and a step-like sidewall opposing to the steep sidewall. Each of the steps has a width smaller than the wavelength of the incident wave. The width is preferably about 1/100th of the wavelength of the incident wave. The trenches are in the formed of a plurality of concentric circular trenches.

The present invention further comprises a reflective Fresnel lens comprising a ground plate and an array of diffractive patterns formed on the ground plate, wherein each of the diffractive patterns comprises a plurality of reflective elements formed at various levels of the ground plate. In one embodiment, each of the diffractive patterns includes a series of concentric circular reflective elements. The reflective elements include a plurality of patterned thin-film conductors. The reflective Fresnel lens further comprises a reflective layer formed on a bottom surface of the ground plate. Alternatively, the reflective elements include a plurality of grooves recessed from a top surface of the ground plate by various depths, and the reflective Fresnel lens further comprises a reflective layer formed on a top surface of the ground plate. Preferably, the reflective layer is conformal to the top surface.

The present invention further provides a millimeter-wave power amplifier comprising an input source operative to generate a local oscillation energy at a predetermined wavelength, an array of amplifiers, operative to amplify the local oscillation energy, at least one reflective Fresnel diffractive lens, wherein the reflective Fresnel diffractive lens comprises a multilevel reflective elements to shape the amplified local oscillation energy, and an array of horn antennas disposed at a focus of the diffractive Fresnel lens. The reflective elements have a width of about 1/100th of the predetermined wavelength. The Fresnel diffractive lens comprises a two-dimensional array of diffractive patterns, and each of the diffractive patterns comprises the multilevel reflective elements. The array of horn antennas includes a two-dimensional array. The array of horn antennas comprises a waveguide.

BRIEF DESCRIPTION OF THE DRAWINGS

These as well as other features of the present invention will become more apparent upon reference to the drawings therein.

DETAILED DESCRIPTION OF THE INVENTION

Figure 1:
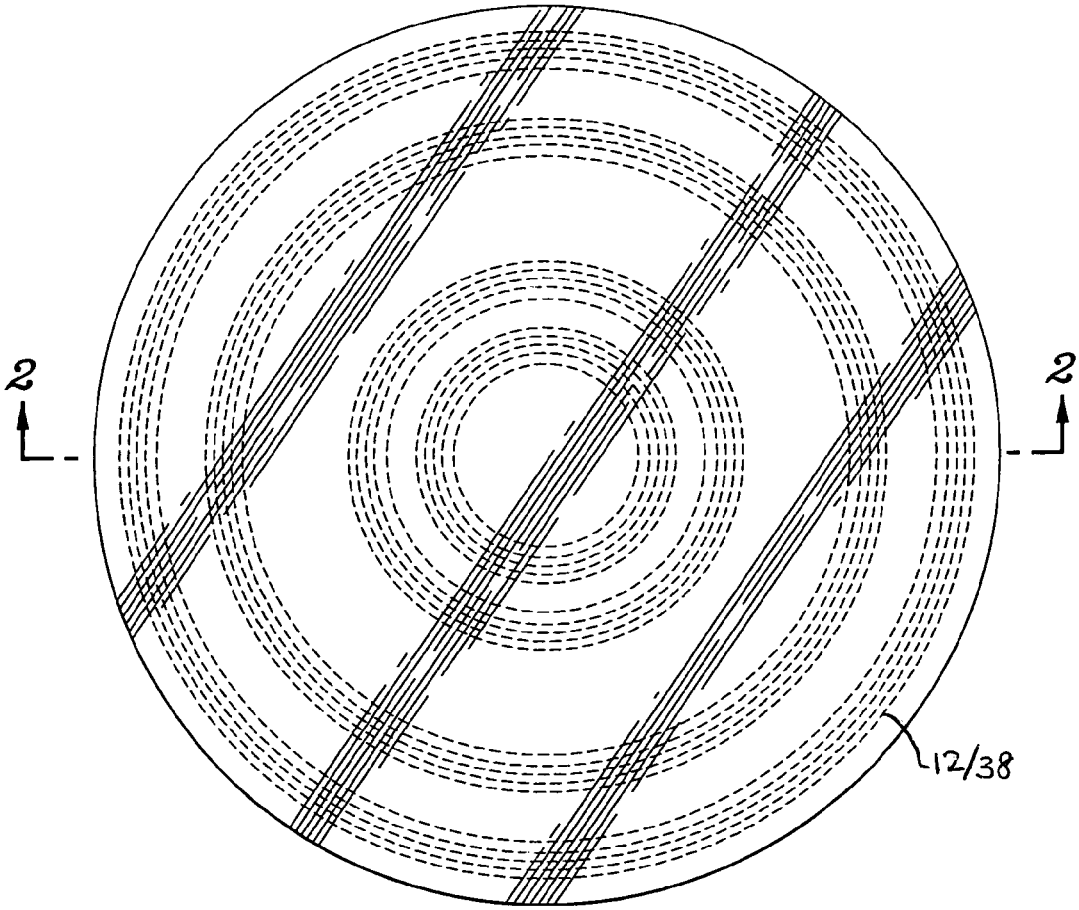
FIG. 1 comprises a top view of a reflective Fresnel diffractive lens in one embodiment of the present invention.
Figure 2:
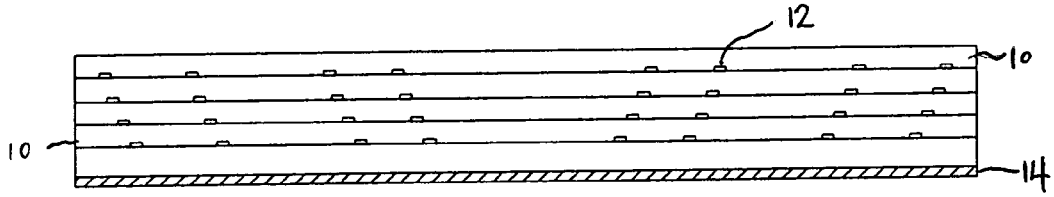
FIG. 2 shows a cross sectional view of one group of diffractive patterns formed on the reflective Fresnel diffractive lens as shown in FIG. 1.
Figure 3:
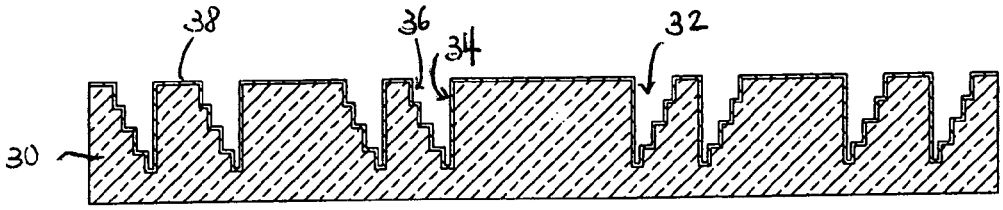
FIG. 3 is a cross sectional view showing a reflective Fresnel diffractive lens according to an alternate embodiment of the present invention.
Figure 4:
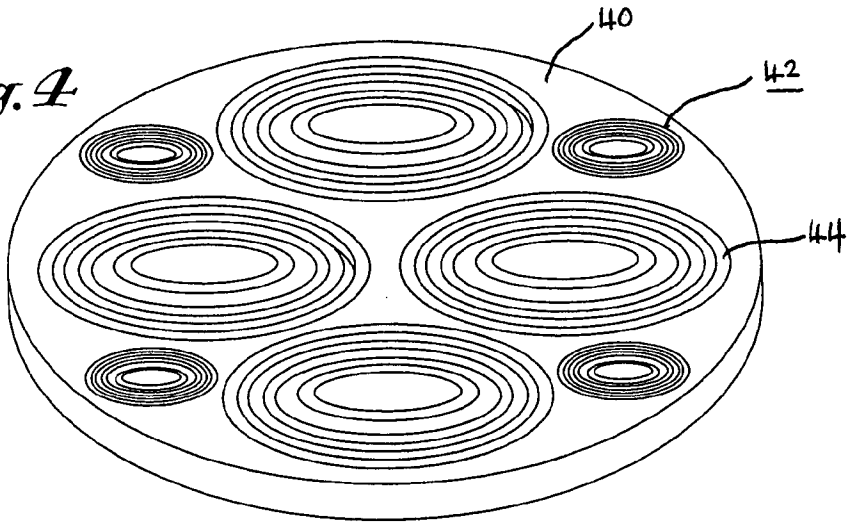
FIG. 4 is a top view of FIG. 3.
Figure 5:
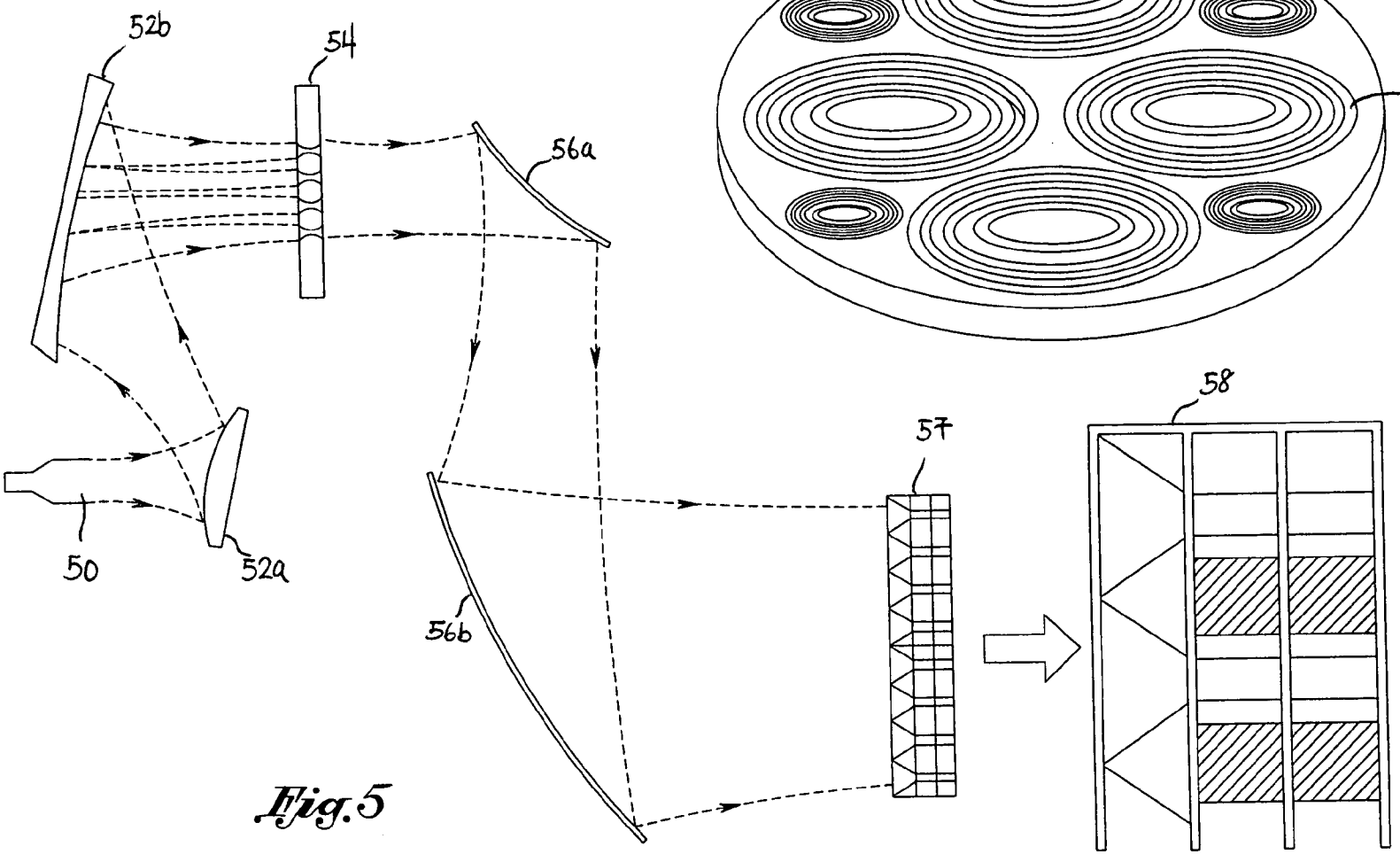
FIG. 5 shows a free-space combined array of amplifier.

Referring now to the drawings wherein the showings are for the purpose of illustrating preferred embodiments of the present invention only, and not for the purposes of limiting the same, FIG. 1 is a top view of a reflective Fresnel lens which comprises a plurality of substrates stacked with each other, and FIG. 2 is a cross sectional view of the reflective Fresnel lens as shown in FIG. 1. FIG. 3 is a cross sectional view of a reflective Fresnel lens of comprising a plurality of reflecting surfaces formed at various levels, and FIG. 4 shows the top view of the reflective Fresnel lens as shown in FIG. 3. FIG. 5 comprises a power system incorporating the reflective Fresnel lens for shaping a millimeter or sub-millimeter wave into a desired shape.

A Fresnel lens typically comprises a series of concentric and coplanar annual grooves lying on a common transparent plate. The concentric annual grooves normally have a common focus, and the width of the grooves defines the optical performance of the Fresnel lens. When the width of the grooves is smaller than the wave traversing through the Fresnel lens, the series of grooves functions as a series of diffractive elements, and the Fresnel lens operates as a diffractive Fresnel lens. In this embodiment, instead of forming grooves on a common transparent plate, reflective elements are formed at various levels. The width of the reflective element is smaller than the optical wave. When a beam or an optical wave is incident on the reflective Fresnel lens, the beam or optical wave impinging on the reflective elements at different levels is reflected thereby with a different optical path difference. As a result, the optical waves impinging the reflective elements at various levels are diffracted into a desired shape to propagate away from the reflective Fresnel lens towards a destination such as a detector array. It is appreciated that geometries and locations of the reflective elements are variable in accordance with the shape of the optical wave as desired at the destination.

FIG. 1 shows a top view of a reflective Fresnel lens in one embodiment of the present invention, and FIG. 2 shows a cross sectional view of a portion of the reflective Fresnel lenses as shown in FIG. 1. As shown in FIGS. 1 and 2, the reflective Fresnel lens includes a plurality of substrates or lens 10 stacked together. Preferably, each of the substrates 10 is transparent within at least a specific wavelength range. In this embodiment, the specific wavelength range includes microwave wavelengths, millimeter wavelengths and/or sub-millimeter wavelengths. Therefore, the material selected for fabricating the substrates 10 is at least transparent to microwave, millimeter wave and/or sub-millimeter wave. Glass is one exemplary material for fabricating the substrates 10 transparent to microwave, millimeter wave, and/or sub-millimeter wave.

As shown in FIG. 2, each of the substrates 10 includes a plurality of reflective elements 12 formed thereon. In this embodiment, the reflective elements 12 include a layer of patterned thin-film conductor, and the thin-film conductor is fabricated from gold, for example. Preferably, the thickness of the reflective elements 12 are so thin that when the thin-film conductors are stacked together, no significant thickness increment can be observed by formation of the reflective elements 12. The width of the thin-film conductors is preferably about 1/100th of the wavelength of the optical wave incident on the reflective Fresnel lens. When the transparent substrates 10 are stacked as shown in FIG. 2, a multilevel reflective pattern can be obtained. In this embodiment, reflective elements 12 on each transparent substrate 10 are configured into a plurality of concentric circular rings. Therefore, a plurality of circular reflective elements 12 formed at various levels of the Fresnel lens is shown as the dash lines in FIG. 1. It will be appreciated that the configurations of the reflective elements 12 are variable according to the required shape of the optical beam output from the reflective Fresnel lens. Further, the position and number of the groups, and the number of the reflective elements 12 on each substrate 10 are determined according to the specific shape of the optical wave emerging from the Fresnel lens as required at a predetermined position.

As shown in FIG. 2, the Fresnel lens further comprises a reflective layer 14 coated at a bottom surface of the ground plate, which includes the stack of the substrates 10 in the embodiment as shown in FIG. 2. Therefore, as mentioned above, an incident optical wave or electromagnetic wave impinging on any of the reflective elements 12 at any level is reflected thereby, while the wave which does not impinge any of the reflective elements 12 propagates through all the transparent substrates 10 to be reflected by reflective layer 14. The waves reflected from the reflective elements 12 and the reflective layer 14 at various levels are then interfered (diffracted) with each other to form an output wave with a desired shape.

FIG. 3 shows a cross sectional view of a reflective Fresnel lens provided in another embodiment. The Fresnel lens comprises a dielectric substrate 30 which has one side patterned by processes such as electron beam lithography, ion milling, and etching, for example. During the patterning process, various depths of the substrate 30 at this side are removed to form a plurality of recessed areas 32 in the substrate 30. In this embodiment, each of the recessed areas 32 includes a one straight vertical sidewall 34 and one stair-like sidewall 36 opposing to the straight sidewall 34 as shown in FIG. 3. The recessed areas 32 may be formed with various cross sectional configurations according to the desired shape of the optical wave output from the reflective Fresnel lens. Further referring to FIG. 3, a reflective coating 38 is formed on the patterned side of the substrate 30, such that optical or electromagnetic wave incident on the side of the substrate 30 will be reflected thereby without encountering any dielectric loss. Preferably, the reflective coating 38 is conformal to the surface profile of the patterned side of the substrate 30, such that an optical wave or an electromagnetic wave incident on the top side of the substrate 30 will be reflected from various levels to be redistributed and reconstructed.

FIG. 4 illustrates a perspective view of a reflective Fresnel lens comprising an array of diffractive patterns 42 formed in a ground plate 40. Each of the diffractive patterns includes a plurality of concentric circular grooves 44 recessed from a top surface of the ground plate 40 at various levels. A reflective layer is coated on the top surface of the ground plate 40 to facilitate reflection of an incident optical or electromagnetic wave. The reflective layer is conformal to the surface profile of the ground plate 40, such that the incident optical or electromagnetic wave is reflected and refracted into a desired shape.

FIG. 5 illustrates a power system incorporates an array of free-space combined amplifiers. As shown, a local oscillator (LO) energy is originated by a single source 50. Preferably, the local oscillation energy is in the form of a millimeter wave, a sub-millimeter wave or a microwave propagating towards a pair of reflectors 52*a* and 52*b*. By adjusting the distance and orientation of the pair of reflectors 52*a* and 52*b*, the wave is directed towards the array of free-space combined amplifiers, which comprises a grid amplifier 54, a pair of reflective lens 56*a* and 56*b*, and an array of horn antenna 57. The grid amplifier 54 amplifies the wave and feeds the amplified wave into the reflective Fresnel lens 56*a*. As mentioned above, the reflective Fresnel lens 56*a* includes an array of reflective patterns formed at various levels. Therefore, the wave incident on each diffractive pattern 42 of the reflective Fresnel lens 56*a* is reflected from various levels and diffracted into a desired shape. An additional reflective Fresnel lens 56*b* is preferably located along an optical path of the wave reflected from the reflective Fresnel lens 56*b* to serves as a collimator. On the optical path of the wave collimated by the reflective Fresnel lens 56*b*, an array of micro-machined horn antennas 57 is disposed to deliver the collimated wave to an array of detectors elements. Preferably, an array of waveguides 58 is used in combination with the horn antennas 57 for delivering the shaped wave.

This disclosure provides exemplary embodiments of a reflective Fresnel lens for efficient, uniform sub-millimeter wave power distribution. The scope of this disclosure is not limited by these exemplary embodiments. Numerous variations, whether explicitly provided for by the specification or implied by the specification, such as variations in shape, structure, dimension, type of material or manufacturing process may be implemented by one of skill in the art in view of this disclosure.

What is claimed is:

1. A Fresnel lens for reflectively shaping an incident wave, the Fresnel lens comprising:

a plurality of substrates;

a plurality of reflective elements enveloped by the substrates at multiple levels for shaping the incident wave; and a reflective layer disposed on a bottom surface of at least one of the substrates.

2. The Fresnel lens of claim 1, wherein the reflective elements are sized and configured to reflectively shape the incident wave in a millimeter wavelength range.

3. The Fresnel lens of claim 1, wherein the reflective elements are sized and configured to reflectively shape the incident wave in a sub-millimeter wavelength range.

4. The Fresnel lens of claim 1, wherein the reflective elements are sized and configured to reflectively shape the incident wave in a microwave wavelength range.

5. The Fresnel lens of claim 1, wherein the substrates are transparent to the incident optical wave.

6. The Fresnel lens of claim 1, wherein the reflective layer includes a conductor coating.

7. The Fresnel lens of claim 1, wherein the substrates are fabricated from glass.

8. The Fresnel lens of claim 1, wherein the reflective elements include a plurality of patterned thin-film conductors.

9. The Fresnel lens of claim 8, wherein the patterned thin-film conductors have a width smaller than a wavelength of the incident wave.

10. The Fresnel lens of claim 8, wherein the patterned thin-film conductors have a width of about $1/100^{th}$ of the wavelength of the incident wave.

11. The lens of claim 1 wherein the reflective elements are formed upon the substrates.

12. The Fresnel lens of claim 1, wherein the reflective elements are located between the substrates.

13. A Fresnel lens for reflectively shaping an incident wave, the Fresnel lens comprising:

a substrate having a recess defining an inner sidewall and an outer sidewall, the outer sidewall being located further from a center of the lens than the inner sidewall, the outer sidewall having at least two steps formed at various levels; and a reflective coating on the steps of the outer sidewall.

14. The Fresnel lens of claim 13, wherein the reflective coating on the steps of the outer sidewall forms reflective elements at various levels of the substrate.

15. The Fresnel lens of claim 13, wherein the recess is formed on a top side of the substrate.

16. The Fresnel lens claim 15, wherein the reflective coating is conformal to a surface profile of the top side of the substrate.

17. The Fresnel lens of claim 13, wherein each of the steps has a width smaller than the wavelength of the incident wave.

18. The Fresnel lens of claim 13, wherein each of the steps has a width of about $1/100^{th}$ of the wavelength of the incident wave.

19. The Fresnel lens of claim 13, wherein each step has a circular configuration, and the steps are concentric.

20. A Fresnel lens for reflectively shaping an incident wave, the lens comprising:

a substrate;

an array of diffractive patterns formed on the substrate, wherein at least one of the diffractive patterns forms a recess defining an inner sidewall and an outer sidewall, the outer sidewall having at least two steps formed at various levels, the outer sidewall being located further from a center of the diffractive pattern than the inner sidewall; and a reflective coating on the steps of the outer sidewall of at least one of the diffractive patterns.

21. The Fresnel lens of claim 20, wherein the diffractive pattern includes a series of concentric circular reflective elements.

22. The Fresnel lens of claim 20, wherein the reflective coating on the steps include a plurality of patterned thin-film conductors.

23. The Fresnel lens of claim 20, wherein the array of diffractive patterns is formed on a top side of the substrate.

24. The Fresnel lens of claim 23, wherein the reflective coating is conformal to the top side.

25. A millimeter-wave power amplifier, comprising:

an input source, operative to generate a local oscillation energy at a predetermined wavelength;

an array of amplifiers, operative to amplify the local oscillation energy;

at least one reflective Fresnel diffractive lens, wherein the reflective Fresnel diffractive lens comprises a multi-level reflective elements to shape the amplified local oscillation energy; and an array of horn antennas disposed at a focus of the diffractive Fresnel lens.

26. The power amplifier of claim 25, wherein the reflective elements have a width of about $1/100^{th}$ of the predetermined wavelength.

27. The power amplifier of claim 25, wherein the Fresnel diffractive lens comprises a two-dimensional array of diffractive patterns, and each of the diffractive patterns comprises the multilevel reflective elements.

28. The power amplifier of claim 27, wherein the array of horn antennas includes a two-dimensional array.

29. The power amplifier of claim 27, wherein the array of horn antennas comprises a waveguide.

* * * * *